US005409593A

United States Patent [19]

Moskowitz

[11] Patent Number: 5,409,593

[45] Date of Patent: Apr. 25, 1995

[54] METHOD AND APPARATUS FOR SELECTIVE ELECTROPLATING USING SOLUBLE ANODES

[75] Inventor: Michael Moskowitz, Beachwood, Ohio

[73] Assignee: Sifco Industries, Inc., Cleveland, Ohio

[21] Appl. No.: 162,000

[22] Filed: Dec. 3, 1993

[51] Int. Cl.[6] ..... C25D 5/06; C25D 17/00; C25D 17/14; C25D 21/02

[52] U.S. Cl. ..... 205/117; 204/224 R; 204/225; 204/237; 204/269; 204/271; 204/275; 204/274; 205/133; 205/148

[58] Field of Search ..... 204/224 R, 271, 225, 204/237, 241, 267, 275, 274, 269; 205/117, 133, 148

[56] References Cited

U.S. PATENT DOCUMENTS

| | | | |
|---|---|---|---|
| 2,587,630 | 3/1952 | Konrad et al. | 204/113 X |
| 2,802,085 | 8/1957 | Rothacker | 219/10.53 |
| 2,980,596 | 4/1961 | Conway | 204/67 |
| 3,001,925 | 9/1961 | Berry | 204/224 R |
| 3,468,785 | 9/1969 | Polichette | 204/224 R |
| 3,637,468 | 1/1972 | Icxi et al. | 204/271 X |
| 3,779,887 | 12/1973 | Gildone | 204/224 R |
| 4,304,654 | 12/1981 | Norris | 204/212 |
| 4,376,690 | 3/1983 | Kugler | 204/243 R |
| 4,634,511 | 1/1987 | Operschall et al. | 204/212 |
| 4,752,367 | 6/1988 | Vishnitsky | 204/129.5 |
| 4,879,015 | 11/1989 | Adamek et al. | 204/244 R |
| 4,931,150 | 6/1990 | Smith | 205/118 |
| 4,992,154 | 2/1991 | Ida et al. | 204/271 X |
| 5,045,161 | 9/1991 | McGregor | 204/129.46 |
| 5,045,167 | 9/1991 | Palnik | 204/206 |
| 5,225,059 | 7/1993 | Penrose | 204/271 X |

FOREIGN PATENT DOCUMENTS

| | | | |
|---|---|---|---|
| 378535 | 7/1973 | U.S.S.R. | 204/224 R |

*Primary Examiner*—Donald R. Valentine
*Attorney, Agent, or Firm*—Welsh & Katz, Ltd.

[57] ABSTRACT

A device is provided for brush electroplating a surface of a workpiece. The device includes an anode generally composed of a metal to be electroplated on the surface of the workpiece. The anode is selectively retained within a cavity formed in a lower surface of a carrier piece composed of a generally electrical non-conductive material. The lower surface of the carrier piece is shaped to conform to at least a portion of the surface of the workpiece. An absorbent material extends over the lower surface of the carrier piece to form a brush. The cover material and lower surface of the anode are spaced from each other to form a chamber. The device also includes an assembly, fluidly connected to the space between the anode and absorbent material, to inject a flow of the electrolytic fluid into the chamber.

21 Claims, 2 Drawing Sheets

METHOD AND APPARATUS FOR SELECTIVE ELECTROPLATING USING SOLUBLE ANODES

FIELD OF THE INVENTION

This invention generally relates to a method and apparatus for electroplating metallic surfaces, and more particularly to a method and apparatus for carrying out electroplating operations on metallic surfaces using brush type soluble anodes.

BACKGROUND OF THE INVENTION

It is frequently desirable to deposit a metal on the surface of a metallic article. This depositing or plating may be needed to restore the original dimensions of the article if the surface has been eroded or improve the wearing or corrosion protection properties of the surface. Typically the plating is accomplished using an electroplating process.

There are many different ways in which the electroplating process may be carried out. If the entire article is to be plated, tank electroplating may be used. In tank electroplating, the article to be plated is electrically connected to act as a cathode and placed in a tank filled with an electroplating solution.

A potential difference is then applied between the cathodic workpiece and an anode, and metal ions from the solution are plated on the article. Concurrently, metal atoms from the anode are converted to metal ions, which dissolve in the electrolytic solution, thereby replenishing the metal content of the solution.

Tank electroplating is not efficient when only a portion of the workpiece is to be plated. To accomplish partial electroplating the other areas of the workpiece must be masked. However, this increases the labor requirements.

To perform electroplating of limited surface areas, a procedure known as brush electroplating was developed. The brush plating apparatus typically employs an anode which is wrapped in an absorbent tool cover material or felt to form a brush. The brush is rubbed over the surface to be plated and an electrolytic solution is injected into the absorbent tool cover material. The electrolytic solution includes metal ions, of the metal to be deposited on the workpiece,, in the form of soluble compounds.

In brush electroplating, soluble anodes, which are composed of the metal to be plated, are not used because the absorbent cover material interferes with efficient agitation of the solution at the anode surface. The interference causes metallic ions to collect at the surface of the anode which polarizes the anode. A polarized anode generally cannot adequately perform the process of electroplating.

Therefore, in brush electroplating insoluble anodes are used. The anodes are typically constructed of graphite, platinum plated or clad titanium or niobium. However, the insoluble anode cannot contribute metal ions for the plating process. Thus the metal ions must be supplied solely from the electrolytic solution. As the metal ions in the electrolytic solution are used, the electrolytic solution becomes depleted and must be replaced. The depleted electrolytic solution must then be disposed of. This depleted electrolytic fluid is typically classified as a hazardous substance; and therefore, disposal of the fluid poses a drawback to using brush electroplating techniques.

It is therefore an object of the present invention to provide an improved method and apparatus for electroplating metallic surfaces and more particularly to providing a method and apparatus for electroplating using brush-type anodes.

It is a further object of the present invention to provide an improved method and apparatus for brush electroplating which reduces the amount of electrolytic fluid depleted during the electroplating process.

It is a still further object of the present invention to provide an improved brush electroplating device which employs soluble anodes.

SUMMARY OF THE INVENTION

Accordingly, a device is provided for brush electroplating a surface of a workpiece. The device includes an anode having a first plating face disposed toward the surface of the workpiece with the anode generally composed of a metal to be electroplated on the surface of the workpiece. An absorbent material or tool cover extends over but is spaced from the first face of the anode. The device also includes an arrangement to inject a flow of electrolytic fluid into the spacing between the absorbent material and the anode.

More particularly, the brush electroplating anode may be retained within a cavity formed in a carrier piece composed of a generally electrical non-conductive material. The lower surface of the carrier piece, where the cavities are located, is shaped to conform to at least a portion of the surface of the workpiece and the absorbent material is stretched over the lower surface.

The carrier piece may have a plurality of the anode devices with each one of the devices being disposed in a separate cavity. The cavities are spaced along a lower face of the carrier piece in the general direction of the movement of the workpiece relative to the carrier, and the flow injecting arrangement injects the electrolytic fluid into the cavity between the absorbent material and the anode.

DESCRIPTION OF THE PREFERRED EMBODIMENT OF THE INVENTION

Figure 1:
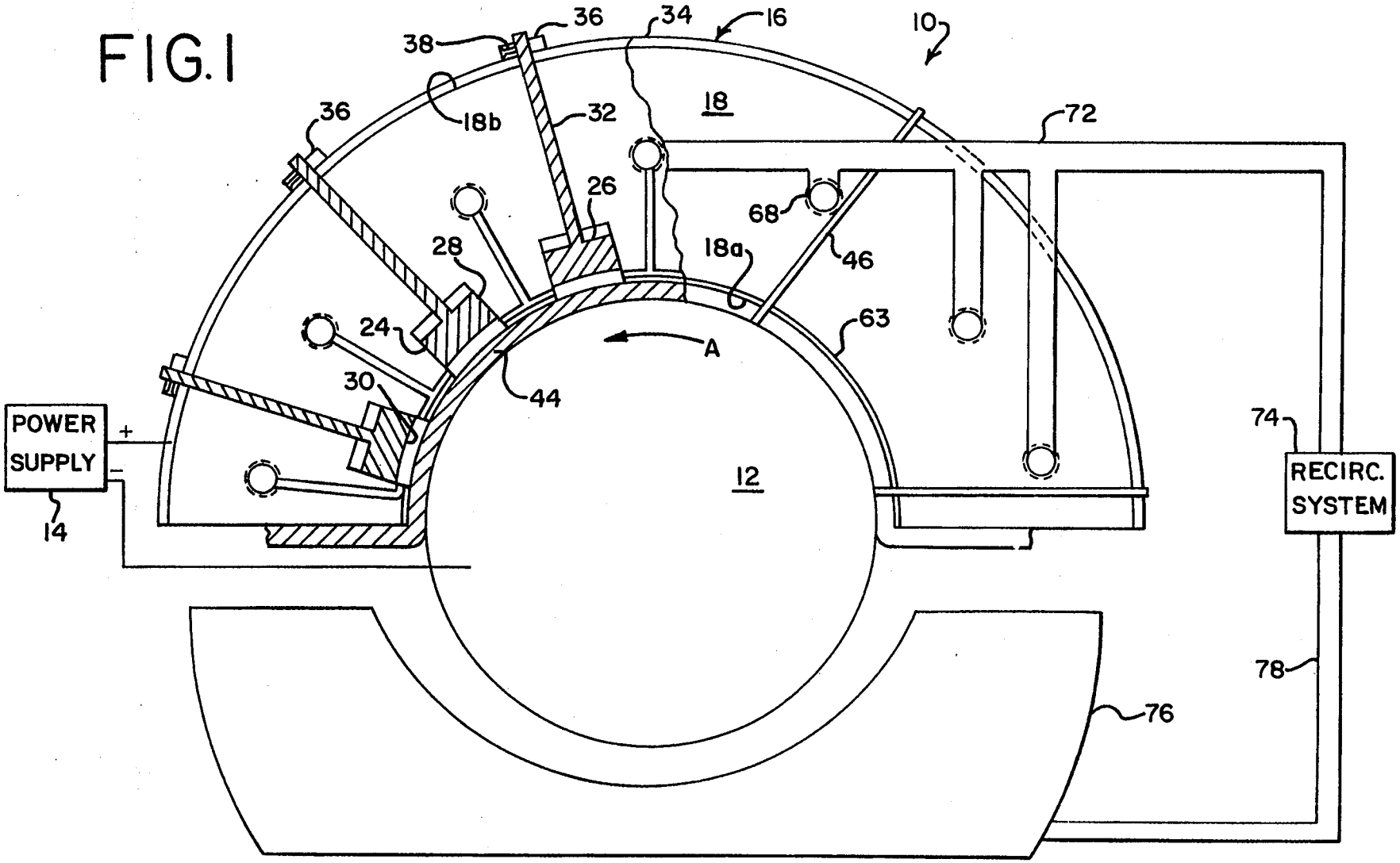
FIG. 1 is an elevational view with parts broken away of an electroplating apparatus using soluble anodes of the present invention.

Referring to FIG. 1, an electroplating apparatus embodying the present invention is generally indicated at 10. The apparatus is shown adapted to electroplate or plate the outer diameter of a cylindrical workpiece 12 such as a shaft. It is anticipated that the apparatus 10 may also be adapted to plate interior cylindrical surfaces, flat areas or other configurations. A negative lead from a direct current power supply 14 is connected by conventional conductors and connections to the workpiece 12, while the positive lead is connected to the apparatus 10 and then to the anodes as described below.

The apparatus 10 has an anode plating tool, generally indicated at 16, with each tool including a carrier 18 composed of a generally non-conductive high temperature material such as chlorinated polyvinyl chloride or the like. A lower surface 18*a* of the carrier 18 is adapted to conform to the portion of the workpiece 12 which is to be plated. In the case of the workpiece being a cylindrical shaft, the lower surface 18*a* has a circular profile. Typically, the carrier 18 is held stationary and the workpiece 12 is rotated by a moving device (not shown) to provide relative movement between the workpiece and carrier. The carrier 10 is held stationary by a holding arrangement (not shown) so that a desired rubbing pressure is applied by the carrier against the surface of the workpiece 12 to be plated.

The carrier 18 has at least one, and preferably a plurality of cavities 24 which extend upward from the lower surface 18*a*. The cavities 24 are preferably spaced from each other along the lower surface 18*a* in the longitudinal direction or direction of movement of the workpiece 12 relative to the tool 16, as indicated by arrow A. Disposed within each of the cavities 24 at a distance upward of the lower surface 18*a* is an anode assembly 26.

The anode assembly 26 includes a lower soluble anode 28 which is composed, at least partly, of the metal which is to be plated onto the workpiece 12. Because of the varying types of metal which are plated onto workpieces 12 the anode can be composed of nickel, cadmium, iron, copper, cobalt, tin, zinc and the like.

The anode 28 is configured so that there is sliding contact between the anode and the walls of the cavity 24. The length of the anode 28 and cavity 24 in the transverse direction is generally equal to the transverse length of the area on the workpiece 12 which is to be plated. Typically, the anode 28 and corresponding cavity 24 have rectangular peripheries with the longer sides extending in the transverse direction. The thickness of the anode 28 is less than the height of the cavity so that the position of a lower surface 30 of the anode 28 may be varied relative to the lower surface 18*a* of the carrier.

The lower surface 30 of the anode 28 is generally planar; however, during use, the contours of the lower surface may be slightly altered by the plating activity without affecting the plating operation. The anode assembly 26 may also include a connecting stud 32 which extends from the backside of the anode 28 to the side of the carrier 18 opposite from the workpiece 12. The stud 32 may be composed of the same metal as the anode or the stud may be any conductive material which does not interfere with the plating operation such as by corroding. The stud 32 extends through and is electrically connected to a conducting bus 34 which extends along a rear surface 18*b* of the carrier 18. The stud 32 functions to provide an electrical connection between the conducting bus 34 and the lower anode 28. The conducting bus 34 is in turn electrically connected to the positive lead of the power supply 14.

Attached to the conducting bus 34 are a number of positioning collars 36 which correspond to the connecting studs 32 of the anode assemblies 26. The stud 32 extends through the collar 36 and is secured to the positioning collar 36 by a set screw 38 which extends through the collar 36 and contacts the stud 32. In addition, by loosening the set screw 38 and sliding the stud 32 relative to the collar 36, the position of the lower face 30 of the anode 28 relative to the lower surface 18*a* of the carrier 18 and the workpiece 12 may be altered.

Covering the lower surface 18*a* of the carrier 18 is a tool cover 44 preferably composed of a polyester-type material. The tool cover 44 is pulled taut along the lower surface 18*a* so that the tool cover generally conforms to the lower surface, and is retained on the carrier 18 by a number of straps 46 which are composed of the hook fabric of a hook and pile attachment arrangement. Each of the straps 46 extend about the backside of the carrier 18 with the opposing ends of each of the straps 46 attached to the material of the tool cover 44. It is also anticipated that other methods of affixing the tool cover 44 to the carrier 18, such as polypropylene string, may be employed.

Figure 2:
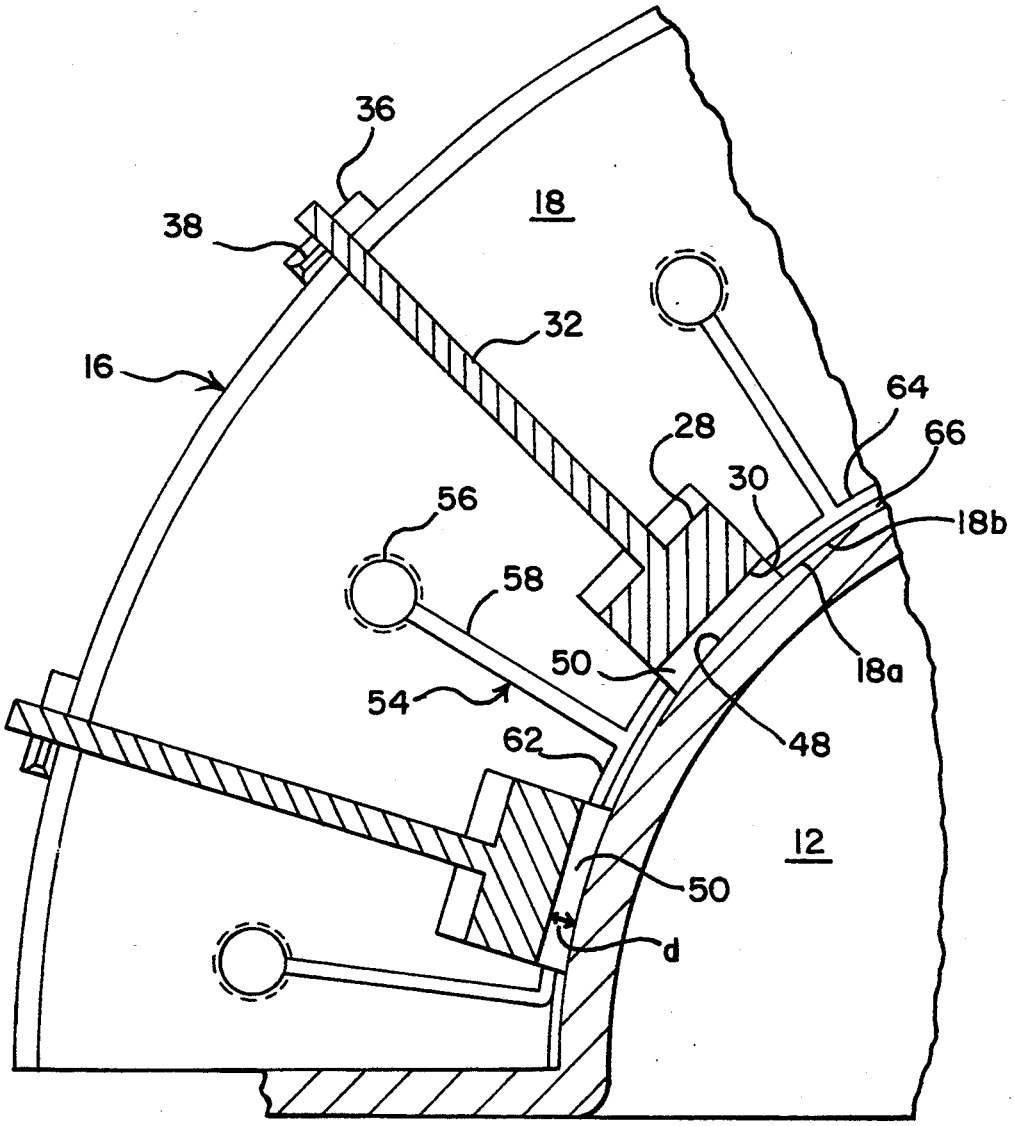
FIG. 2 is an enlarged view of a portion of FIG. 1.

Referring to FIG. 2, the lower surface 30 of anode 28 is positioned inward from the lower surface 18*a* of the carrier 18. The lower surface 30 of the anode, an upper surface 48 of the tool cover 44 and the sidewalls of the cavity 24 form an anolyte chamber 50. The lower surface 30 of the anodes 28 and the upper surface 48 of the tool cover 44 form a vertical spacing indicated at "d".

The carrier 18 includes a set of conduits 54 to controlledly direct a flow of electrolytic solution to each of the anolyte chambers 50. Preferably each of the anode assemblies 26 is bracketed by two of the conduits 54. Each of the conduits 54 is connected to a supply port 56 which transversely extends through the carrier 18 generally parallel to the lower surface 18*b* of the carrier.

The conduits 54 also include a series of bores 58, spaced along the length of the port 56, which extend from the port 56 to the lower surface 18*b*. Each of the bores 58 is connected to at least one passageway 62 extending generally longitudinally to an adjacent anolyte chamber 50. In the situations where the bore 58 extends downward between cavities 24, the passageways 62 may extend in opposite directions to the adjacent anolyte chambers 50. The bores 58 and corresponding passageways are generally spaced along the port 56 so that flows of electrolytic solution are provided to the anolyte chamber 50 at points spaced along the entire transverse length of the anode 28 and anolyte chamber 50.

The passageway 62 may be formed by cutting a groove 64 along an intermediate surface 63 of the carrier 18 generally in the longitudinal direction. A plastic sheet 66 is fitted over the intermediate surface 63 of the carrier 18 to enclose the groove 62 and form the passageway 62 with the plastic sheet forming the lower surface 18*a* of the carrier. The passageways 62 may also be formed by other methods and have varying cross sectional configurations to provide different flow patterns.

The passageway 62 is formed so that as the electrolytic solution is injected into the anolyte chamber 50, the solution flows generally along the lower face 30 of the anode 28. Flowing the solution along the lower face 30 creates agitation about the lower face to flush the lower surface and prevent the buildup of metal ions which may polarize the anode 28 and choke down the electroplating process. The passageways 62 may also be slightly angled upward relative to the lower face 18*b* of the carrier 18 to direct the electrolytic solution into the lower face 30 of the anode 28. In contrast, injecting the electrolytic solution into the tool cover 44 may not create sufficient agitation about the lower face 30 of the anodes 28 to flush away a choking buildup of metallic ions.

Referring back to FIG. 1, a fitting 68, threaded into the port 56, connects an electrolytic solution supply tube 72 to the port. The supply tube 72 is in turn fluidly connected to the discharge of a recirculation device 74 which supplies an adjustable flow rate of electrolytic fluid to the supply tube and then on to the conduit 54. A catch basin 76 is positioned below the carrier 18 and workpiece 12 to collect electrolytic fluid which has been discharged from the carrier. A tube 78 fluidly connects the catch basin 76 to the suction of the recirculation device 74.

To provide a temperature controlled, filtered flow of the electrolytic solution to the conduits, the recirculation device should include a fluid heater or the like (not shown) and a filtering mechanism or the like (not shown).

The sum of the longitudinal widths or total width 18*a* of all the anodes 28 relative to the longitudinal width of the lower surface 18*a* of the carrier 18 may be varied. In the shown embodiment, the total longitudinal width of the anodes 28 is preferably 50% of the longitudinal width of the lower surface 18*a* of the carrier, but the total longitudinal width may vary from 20%–70% of the longitudinal width of the carrier 18. Too great a width of the anodes 28 relative to the carrier 18, may decrease the spacing between the anodes and cause difficulty in the providing of the electrolyte solution to the anolyte chambers 50. Too small a width of the anodes 28 may present, to the workpiece 12, so little surface area of the lower surface 30 of the anode 28 that the time needed to complete plating operation is uneconomical.

The electroplating of the workpiece 12 by the anode tool 16 and the prevention of the polarization of the anode 28 is influenced by the distance "d" between the anode and the tool cover 44 as well as the flow of electrolytic fluid through the anolyte chambers 50. If the distance d is too small, there may be insufficient room to allow the flow of electrolytic fluid across the lower surface 30 of the anode. However, as the distance d increases the voltage differential needed to apply a proper plating current increases. The preferred distance is approximately 1/16–3/16 of an inch.

In operation, the anode tool 16 and workpiece 12 are properly aligned with each other so that the desired pressure is exerted by the tool cover 4.4 on the surface of the workpiece. The power supply 14 is adjusted to give the desired current density. The current density is related to the type of electroplating solution used and may range from 1 to 10 amps per square inch of surface area of the lower surface 30 of the anode 28.

The device (not shown) for moving the workpiece 12 relative to the tool 16 is activated, and the recirculation device 74 is activated to supply an electrolyte flow of about 20–40 gallons per hour per square inch of surface of the lower face 30 of the anode 28. The recirculation device 74 may also be adjusted to heat the electrolytic fluid to a desired temperature. The electrolytic fluid flows through the conduits 54 and is injected into anolyte chambers 50 typically from both sides of the chamber. Upon entering the anolyte chambers 50, the electrolytic fluid absorbs ions being emitted from the lower surface 30 of the anode 28. In addition, the turbulence of the flow of the electrolytic fluid across lower surfaces of the anode 28 prevents a build up of the metallic ions at the lower surface 30 which prevents polarization of the anode.

Metal ions in the electrolytic solution are moved by the potential difference between the anode 28 and workpiece 12 and are plated on the moving workpiece 12. The electrolytic solution then flows from the workpiece 12 and is collected in a catch basin 76. From the catch basin 76 the fluid is returned to the recirculation device 74.

Because a portion of the metal ions needed in the electroplating operation is obtained from the anode 28, the rate of depletion of metal ions in the electrolytic fluid during the brush electroplating operation is reduced. For example, in a brush electroplating operation using non-soluble anodes to plate nickel, the electrolytic solution is depleted after being exposed to 100 amp/-hours for each gallon of solution. In contrast, in the above described operation, the electrolytic fluid may be exposed to approximately 300 amp/hours for each gallon of solution.

To vary the physical characteristics of the metal which is deposited by the electroplating operation on the workpiece 12, to vary the speed of plating various different formulations of electrolytic solution may be used in conjunction with the anodes 28. For example, to form a nickel plating having a dense, ductile continuous deposit structure, Watts Nickel solution may be used with a nickel anode 28. The Watts Nickel solution is one generally known in the electroplating art. The solution may be prepared by mixing water with 60 grams/liter Nickel Chloride, 30 grams/liter Nickel Sulfate and 30 grams/liter Boric Acid. Each liter of this solution is treated with 1 milliliter $H_2O_2$ and 5 g activated carbon, mixed, heated to 180 degrees Fahrenheit, then filtered and pH adjusted to 2.8. The Watts Nickel solution is injected into the anolyte chamber 50 at a solution temperature of approximately 130 degrees Fahrenheit and a deposition rate of 0.40 mils/min. at 100% coverage may be obtained. The deposit hardness of the resulting deposit is approximately $HV_{200}410$.

To obtain a nickel plating deposit having a dense, low stress, defect free structure a Sulfamate Nickel solution may be used with the nickel anode 28. A suitable Sulfamate Nickel solution may include the AERONIKL ® solution available from Sifco Selective Plating, Inc., Cleveland, Ohio. The Sulfamate Nickel solution (AERONIKL 400) is injected into the anolyte chamber 50 at approximately 140–160 degrees Fahrenheit and a deposition rate of 0.64 mils/min. at 100% coverage may be obtained. The hardness of the resulting nickel plating is approximately $HV_{200}400$.

To obtain a hard, wear resistant nickel plating deposit having a micro-porous structure which is beneficial for oil retention and therefore lubrication, an ESL High Speed TM nickel solution from Sifco Selective Plating, Inc. may be used. The ESL solution may be injected into the anolyte chamber 50 at a solution temperature approximately 68–130 degrees Fahrenheit to obtain a deposition rate of approximately 0.85 mils/min. at 100% coverage. The resulting plating deposit is a very hard, micro-porous, and exhibits a hardness of $HV_{200}580$. Because of the micro-porous structure, no corrosion resistance is provided.

A specific embodiment of the novel selective brush electroplating using soluble anodes according to the present invention has been described for the purposes of illustrating the manner in which the invention may be made and used. It should be understood that implementation of other variations and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

I claim:

1. A device for brush electroplating a surface of a workpiece comprising:

at least one anode having a lower plating face disposed toward the surface of the workpiece, said anode being generally composed of a metal to be electroplated on the surface of the workpiece;

a tool cover extending between said plating face and the workpiece, said tool cover and said plating face defining a spacing between said plating face and said tool cover;

means in the fluid communication with said spacing for injecting a flow of electrolytic fluid into said spacing; and means operatively attached to said anode for selectively varying the spacing between said plating face and said tool cover.

2. A device for brush electroplating a surface of a workpiece comprising:

at least one anode having a lower plating face disposed toward the surface of the workpiece, said anode being generally composed of a metal to be electroplated on the surface of the workpiece;

a tool cover extending between said plating face and the workpiece, said tool cover and said plating face defining a spacing between said plating face and said tool cover; and means in the fluid communication with said spacing for injecting a flow of electrolytic fluid into said spacing, said injecting means includes means for varying the temperature of the electrolytic fluid injected into said spacing.

3. A device for brush electroplating a surface of a workpiece comprising:

at least one anode having a lower plating face disposed toward the surface of the workpiece, said anode being generally composed of a metal to be electroplated on the surface of the workpiece;

a tool cover extending between said plating face and the workpiece, said tool cover and said plating face defining a spacing between said plating face and said tool cover;

means in the fluid communication with said spacing for injecting a flow of electrolytic fluid into said spacing, said injecting means includes means for recirculating electrolytic fluid previously injected into said spacing.

4. The device of claim 3 wherein said tool cover is spaced from said plating face to provide sufficient width between said tool cover and said plating face so that the fluid flows across said plating face to create agitation along said face.

5. The device of claim 3 where said injecting means includes means for flowing the fluid across said plating face.

6. The device of claim 3 wherein said injecting means includes means for directing the flow of fluid at said plating face.

7. A device for brush electroplating a surface of a workpiece comprising:

a plurality of anodes each having a lower plating face disposed toward the surface of the workpiece, said anodes being generally composed of a metal to be electroplated on the surface of the workpiece;

a tool cover extending between said plating faces and the workpiece, to define a spacing between said tool cover and said plating face corresponding to each of said anodes; and means in fluid communication with said spacings for injecting a flow of electrolytic fluid into each of said corresponding spacings.

8. An assembly for brush electroplating a surface of a workpiece comprising:

a carrier piece composed of a generally electrical nonconductive material, said carrier piece having a surface, a portion of said surface shaped to conform to at least a portion of the surface of the workpiece, said carrier piece forming at least one cavity extending inward from said conforming portion;

an anode disposed in said at least one cavity, said anode having a plating face and being generally composed of a metal to be electroplated on the surface of the workpiece;

a tool cover extending over said portion of said conforming surface and between said plating face and said workpiece, said tool cover and said plating face defining a spacing between said plating face and said tool cover; and means in fluid communication with said spacing for injecting a flow of electrolytic fluid into said spacing.

9. The assembly of claim 8 wherein said carrier forms a plurality of said cavities extending inward from said conforming surface, at least one of said anodes being disposed in each of said cavities.

10. The assembly of claim 9 wherein said at least one anode is slidably disposed in said cavity.

11. The assembly of claim 10 further including means operably connected to said at least one anode for selectively positioning said at least one anode in said cavity.

12. The assembly of claim 9 wherein said plurality of cavities are spaced from each other and aligned in a direction of movement of said carrier piece relative to said workpiece.

13. The assembly of claim 12 wherein said cavities have a length extending in a direction transverse to said movement direction, said injecting means including means for injecting discrete flows of the electrolytic fluid at locations spaced along the length of said cavities.

14. The assembly of claim 8 wherein said injecting means includes means for varying the temperature of the electrolytic fluid injected into said spacing.

15. The assembly of claim 8 wherein said injecting means includes means for recirculating electrolytic fluid previously injected into said spacing.

16. The device of claim 8 wherein said tool cover is spaced from said plating face to provide sufficient width between said tool cover and said plating face so that said fluid flows across said face to create agitation along said face.

17. The device of claim 8 wherein said injecting means includes means for directing the flow of fluid across said plating face.

18. A method for brush electroplating a workpiece comprising the steps of:

disposing an anode, having a lower plating surface composed generally of the material to be plated onto the workpiece, in a cavity formed by a carrier piece, said carrier piece having a lower surface with at least a portion of said lower surface configured to conform to at least a portion of the surface of the workpiece;

extending a tool cover over said portion of said lower surface of said carrier piece and between said anode and the workpiece, said disposing including spacing said anode surface from said tool cover;

injecting a flow of electrolytic fluid into the spacing between said anode surface and said tool cover;

creating a current flow between said anode and the workpiece;

moving the workpiece relative to said carrier; and recirculating the electrolytic fluid injected into the spacing.

19. The method of claim 18 wherein said spacing step includes separating said anode surface from said tool cover to provide sufficient room between said tool cover and said anode surface so that said fluid flows across said anode surface to create agitation along said face.

20. The method of claim 18 where said injecting step includes directing the flow of fluid along said anode surface.

21. An assembly for brush electroplating a surface of a workpiece comprising:

a carrier piece composed of a generally electrical nonconductive material, said carrier piece having a surface, a portion of said surface shaped to conform to at least a portion of the surface of the workpiece, said carrier piece forming at least one cavity extending inward from said conforming portion;

an anode disposed in said at least one cavity, said anode having a plating face and being generally composed of a metal to be electroplated on the surface of the workpiece;

a tool cover extending over said conforming portion and between said anode and the workpiece, said tool cover and said plating face defining a spacing between said plating face and said tool cover;

means operatively attached to said anode for selectively varying the spacing between said plating face and said tool cover; and means in fluid communication with said spacing for injecting a flow of electrolytic fluid into said spacing.

* * * * *